US010306383B2

(12) United States Patent
Gustafsson

(10) Patent No.: US 10,306,383 B2
(45) **Date of Patent: *May 28, 2019**

(54) MAGNETIC USER INTERFACE CONTROLS

(71) Applicant: Cochlear Limited, Macquarie University, NSW (AU)

(72) Inventor: Johan Gustafsson, Gothenburg (SE)

(73) Assignee: Cochlear Limited, Macquarie University (AU)

( * ) Notice: Subject to any disclaimer, the term of this patent is extended or adjusted under 35 U.S.C. 154(b) by 0 days.

This patent is subject to a terminal disclaimer.

(21) Appl. No.: 15/975,084

(22) Filed: May 9, 2018

(65) Prior Publication Data

US 2018/0262851 A1 Sep. 13, 2018

Related U.S. Application Data

(63) Continuation of application No. 14/802,437, filed on Jul. 17, 2015, now Pat. No. 9,986,349.

(60) Provisional application No. 62/025,742, filed on Jul. 17, 2014.

(51) Int. Cl.
*H04R 25/00* (2006.01)

(52) U.S. Cl.
CPC ..... *H04R 25/558* (2013.01); *H04R 25/606* (2013.01); *H04R 2225/61* (2013.01)

(58) Field of Classification Search
CPC . H04R 25/558; H04R 25/606; H04R 2225/61
USPC ..... 381/315
See application file for complete search history.

(56) References Cited

U.S. PATENT DOCUMENTS

| | | | |
|---|---|---|---|
| 4,352,960 | A | 10/1982 | Dormer et al. |
| 5,553,152 | A | 9/1996 | Newton |
| 5,626,629 | A | 5/1997 | Faltys et al. |
| 5,949,895 | A | 9/1999 | Ball et al. |
| 6,161,046 | A | 12/2000 | Maniglia et al. |
| 6,560,488 | B1 | 5/2003 | Crawford |
| 6,564,807 | B1 | 5/2003 | Schulman et al. |
| 7,571,006 | B2 | 8/2009 | Gordon et al. |
| 7,577,459 | B2 | 8/2009 | Tuomela et al. |
| 8,542,857 | B2 | 9/2013 | Asnes et al. |
| 2005/0209657 | A1 | 9/2005 | Ching et al. |
| 2007/0047749 | A1 | 3/2007 | Kasztelan et al. |

(Continued)

FOREIGN PATENT DOCUMENTS

| | | | |
|---|---|---|---|
| EP | 1160651 | A1 | 12/2001 |
| EP | 2302885 | B1 | 3/2011 |

(Continued)

OTHER PUBLICATIONS

Microchip implant (human)—Wikipedia, the free encyclopedia; http://en.wikipedia.org/wiki/Microchip_implant_(human); printed from the worldwide web on Jul. 18, 2011.

(Continued)

*Primary Examiner* — Phylesha Dabney
(74) *Attorney, Agent, or Firm* — Edell, Shapiro & Finnan, LLC

(57) ABSTRACT

A device includes a magnetic field source that generates a rotationally asymmetric magnetic field, a magnetic field sensor that generates a signal that is indicative of a position of the magnetic field sensor in the rotationally asymmetric magnetic field, and a processor coupled to the magnetic field sensor. The processor is configured to process the signal from the magnetic field sensor to control one or more operational settings of the medical device.

22 Claims, 8 Drawing Sheets

(56) References Cited

U.S. PATENT DOCUMENTS

| | | | |
|---|---|---|---|
| 2007/0055949 | A1 | 3/2007 | Thomas |
| 2007/0208403 | A1 | 9/2007 | Della Santina et al. |
| 2007/0239992 | A1 | 10/2007 | White et al. |
| 2007/0265508 | A1 | 11/2007 | Sheikhzadeh-Nadjar et al. |
| 2008/0025537 | A1 | 1/2008 | Ritter et al. |
| 2009/0079576 | A1 | 3/2009 | Yankelevitz et al. |
| 2009/0163980 | A1 | 6/2009 | Stevenson |
| 2009/0208043 | A1 | 8/2009 | Woods et al. |
| 2010/0046778 | A1 | 2/2010 | Crawford et al. |
| 2011/0044483 | A1 | 2/2011 | Edgar |
| 2012/0197345 | A1 | 8/2012 | Staller |
| 2013/0023954 | A1 | 1/2013 | Meskens |
| 2013/0064404 | A1 | 3/2013 | Ridler et al. |

FOREIGN PATENT DOCUMENTS

| | | | |
|---|---|---|---|
| WO | 2005121939 | A2 | 12/2005 |
| WO | 2007146773 | A1 | 12/2007 |
| WO | 2008121492 | A1 | 10/2008 |
| WO | 2009056167 | A1 | 7/2009 |
| WO | 2010056768 | A1 | 5/2010 |
| WO | 2010017118 | A1 | 7/2010 |
| WO | 2010083389 | A1 | 7/2010 |
| WO | 2013011483 | A2 | 1/2013 |

OTHER PUBLICATIONS

U.S. employees VeriChipped; http://www.spchips.com/prss-releases/us-employees-verichipped.html; Feb. 9, 2006.

International Search Report and Written Opinion of International Application No. PCT/IB2012/053698 dated Feb. 28, 2013 (dated Mar. 4, 2013).

Specification for U.S. Appl. No. 14/543,093, filed Nov. 17, 2014.

MAGNETIC USER INTERFACE CONTROLS

CROSS REFERENCE TO RELATED APPLICATION

The present application is a continuation application of U.S. patent application Ser. No. 14/802,437, filed on Jul. 17, 2015, which in turn claims priority to U.S. Provisional Application No. 62/025,742 filed on Jul. 17, 2014. The entire contents of these applications are incorporated by reference herein.

BACKGROUND

Various types of hearing prostheses provide persons with different types of hearing loss with the ability to perceive sound. Hearing loss may be conductive, sensorineural, or some combination of both conductive and sensorineural. Conductive hearing loss typically results from a dysfunction in any of the mechanisms that ordinarily conduct sound waves through the outer ear, the eardrum, and/or the bones of the middle ear. Sensorineural hearing loss typically results from a dysfunction in the inner ear, such as in the cochlea where sound or acoustic vibrations are converted into neural signals, or any other part of the ear, auditory nerve, or brain that may process the neural signals.

Persons with some forms of conductive hearing loss may benefit from hearing prostheses, such as acoustic hearing aids or vibration-based hearing devices. An acoustic hearing aid typically includes a small microphone to detect sound, an amplifier to amplify certain portions of the detected sound, and a small speaker to transmit the amplified sound into the person's ear. Vibration-based hearing devices typically include a small microphone to detect sound and a vibration mechanism to apply vibrations, which represent the detected sound, directly or indirectly to a person's bone or teeth, thereby causing vibrations in the person's inner ear and bypassing the person's auditory canal and middle ear.

Vibration-based hearing devices include, for example, bone conduction devices, direct acoustic cochlear stimulation devices, and other vibration-based devices. A bone conduction device typically utilizes a surgically implanted mechanism or a passive connection through the skin or teeth to transmit vibrations via the skull. Similarly, a direct acoustic cochlear stimulation device typically utilizes a surgically implanted mechanism to transmit vibrations, but bypasses the skull and more directly stimulates the inner ear. Other vibration-based hearing devices may use similar vibration mechanisms to transmit acoustic signals via direct or indirect vibration applied to teeth or other cranial or facial structures.

Persons with certain forms of sensorineural hearing loss may benefit from implanted prostheses, such as cochlear implants and/or auditory brainstem implants. Generally, cochlear implants and auditory brainstem implants electrically stimulate auditory nerves in the cochlea or the brainstem to enable persons with sensorineural hearing loss to perceive sound. For example, a cochlear implant uses a small microphone to convert sound into a series of electrical signals, and uses the series of electrical signals to stimulate the auditory nerve of the recipient via an array of electrodes implanted in the cochlea. An auditory brainstem implant can use technology similar to cochlear implants, but instead of applying electrical stimulation to a person's cochlea, the auditory brainstem implant applies electrical stimulation directly to a person's brainstem, bypassing the cochlea altogether.

In addition, some persons may benefit from a bimodal hearing prosthesis that combines one or more characteristics of acoustic hearing aids, vibration-based hearing devices, cochlear implants, or auditory brainstem implants to enable the person to perceive sound.

OVERVIEW

The present disclosure relates to a user interface that utilizes a magnetic field to control a device, such as a hearing prosthesis. More particularly, the user interface utilizes a magnetic field sensor that generates a signal that is indicative of the position of the magnetic field sensor in the magnetic field. A processor is configured to process signals from the magnetic field sensor and to use the processed signals to control one or more parameters or operational settings of the device.

In one embodiment, the magnetic field is an asymmetric magnetic field that is characterized by different magnitudes and/or directions at different points in the magnetic field. In contrast, a single bar magnet has a symmetric magnetic field along an axis extending through the north and south poles. The asymmetric magnetic field may be a rotationally asymmetric magnetic field, which is generally a magnetic field that is that is characterized by different magnitudes and/or directions at different points about an axis of the magnetic field. In one example, the axis extends perpendicularly from a plane, and the rotationally asymmetric magnetic field has different magnitudes and/or directions throughout different points that are spaced radially from the axis and parallel to the plane. In this example, a magnetic field sensor may be spaced radially from the axis and may be moved generally parallel to the plane. The magnetic field sensor generates different signals (that are indicative of the magnetic field) as the sensor is moved through the magnetic field, and a processor is configured to interpret these different signals generated by the sensor as user inputs that are used to control operational settings of the device.

Illustratively, the device can be a hearing prosthesis that includes a first component and a second component. In use, the first component may be at least partially implanted in a recipient and the second component may be external to the recipient. Further, the first component can include a first magnetic field source that generates a first asymmetric magnetic field, and the second component can include a second magnetic field source that generates a second asymmetric magnetic field that is complimentary to the first magnetic field. The first component can be coupled to the second component by the first and second complimentary magnetic fields.

In addition, the second component may include a magnetic field sensor that generates signals that are indicative of the position of the magnetic field sensor in the first asymmetric magnetic field. The second component can also include a processor that is configured to process signals from the magnetic field sensor to detect movement of the second component relative to the first component. More particularly, the processor can process the signals from the magnetic field sensor to detect changes in an angular configuration between the first and second components.

The processor can then use these detected changes to control operational settings of the device. In one example, a volume change action can be initiated by a pressing a button of the second component while simultaneously rotating the second component with respect to the first component, and then releasing the button. The magnetic field sensor will generate a signal that is indicative of the rotated angle of the second component. The processor can then change the volume of the device in accordance with the rotated angle. Illustratively, a clockwise rotation of the second component can increase the volume of the hearing prosthesis, while a counter-clockwise rotation can decrease the volume.

In another example, the rotation of the second component with respect to the first component can be used to control other operational settings, such as switching between different user stimulation maps or programs. In this example, the rotation of the second component with respect to the first component may be accompanied by pressing a button in order to initiate the program change.

In another embodiment, the magnetic field may be a symmetric magnetic field, and a plurality of magnetic field sensors can be moved through the symmetric magnetic field. In combination, the plurality of magnetic field sensors generate different signals as the sensors are moved through the magnetic field, and the processor is configured to interpret these different signals generated by the sensors as user inputs that are used to control operational settings of the device.

Generally, the use of a magnetic field and a magnetic field sensor, as disclosed herein, provides a user interface that allows for finer user inputs, as compared to only pushbuttons, for example. Further, the user interface disclosed herein is a simple design that provides an intuitive user interface that may also utilize some components that are already present in some devices (e.g., magnetic coupling components). In addition, the present disclosure is directed to a user interface that can avoid the addition of additional buttons or dial switches to devices that already are designed to have a small form factor.

DETAILED DESCRIPTION

The following detailed description sets forth various features and functions of the disclosed embodiments with reference to the accompanying figures. In the figures, similar reference numbers typically identify similar components, unless context dictates otherwise. The illustrative embodiments described herein are not meant to be limiting. Aspects of the disclosed embodiments can be arranged and combined in a variety of different configurations, all of which are contemplated by the present disclosure. For illustration purposes, some features and functions are described with respect to medical devices, such as hearing prostheses. However, the features and functions disclosed herein may also be applicable to other types of devices, including other types of medical and non-medical devices.

Figure 1:
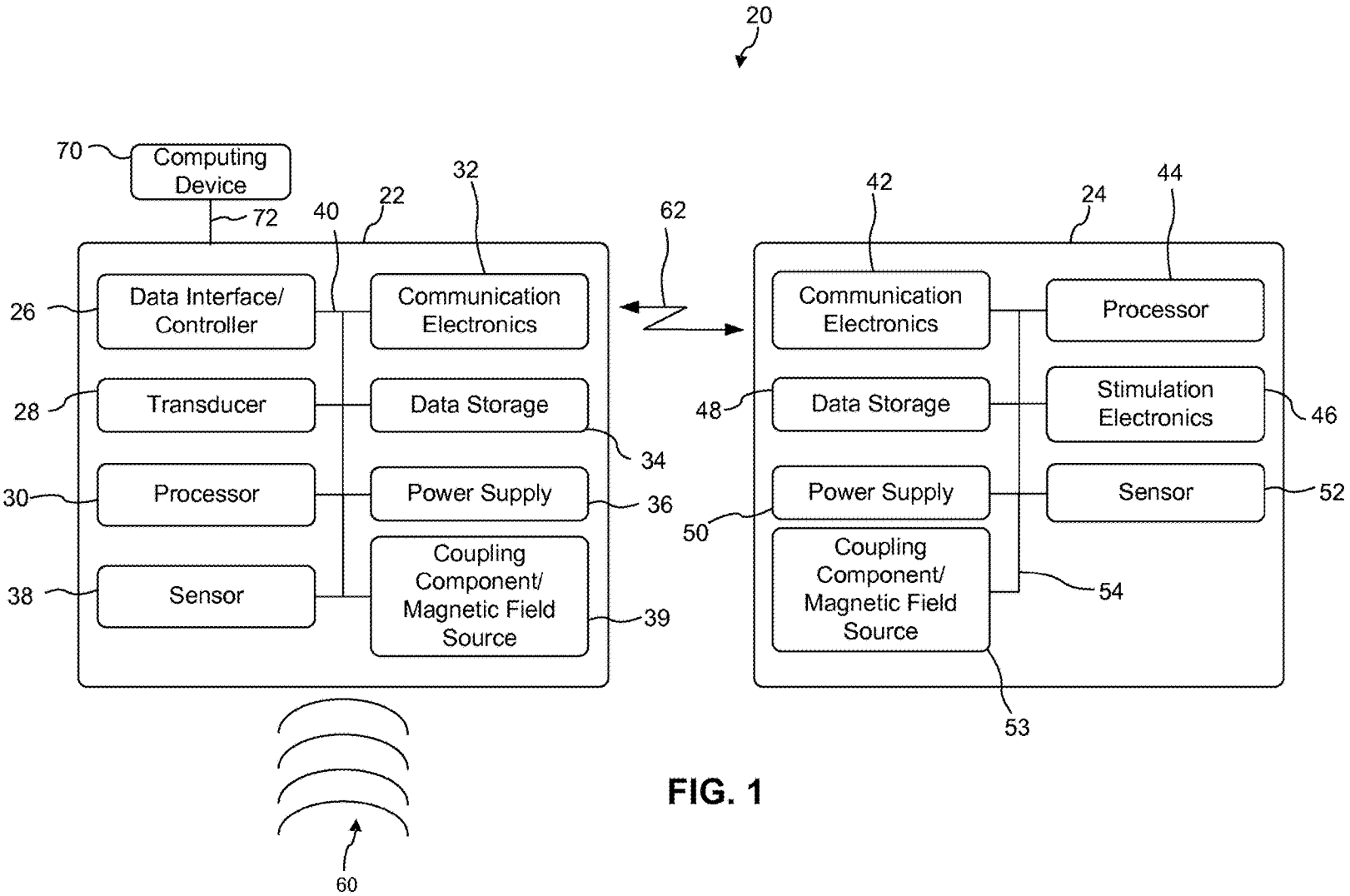
FIG. 1 is a block diagram of a device according to an embodiment of the present disclosure.

Referring now to FIG. 1, an example electronic device or system 20 includes a first component 22 and a second component 24. The device 20 can be a hearing prosthesis, such as a cochlear implant, an acoustic hearing aid, a bone conduction device, a direct acoustic cochlear stimulation device, an auditory brainstem implant, a bimodal hearing prosthesis, a middle ear stimulating device, or any other type of hearing prosthesis configured to assist a prosthesis recipient to perceive sound. In this context, the first component 22 can be generally external to a recipient and communicate with the second component 24, which can be implanted in the recipient. In other examples, the components 22, 24 can both be at least partially implanted or can both be at least partially external to the recipient. In yet other examples, the first and second component 22, 24 may be combined into a single operational component or device. In such examples, the single unit (i.e. combined first component 22 and second component 24) may be totally implanted. Generally, an implantable component or device can be hermetically sealed and otherwise adapted to be at least partially implanted in a person.

In FIG. 1, the first component 22 includes a data interface or controller 26 (such as a universal serial bus (USB) controller), one or more transducers 28, a processor 30 (such as digital signal processor (DSP)), radio electronics 32 (such as an electromagnetic radio frequency (RF) transceiver), data storage 34, a power supply 36, one or more sensors 38, and a coupling component 39, all of which may be coupled directly or indirectly via a wired conductor or wireless link 40. In the example of FIG. 1, the second component 24 includes radio electronics 42 (such as another RF transceiver), a processor 44, stimulation electronics 46, data storage 48, a power supply 50, one or more sensors 52, and a coupling component 53, all of which may be coupled directly or indirectly via a wired conductor or wireless link 54.

In use, the first component 22 may be coupled to the second component 24 by the coupling components 39, 53. These coupling components 39, 53 may each include magnets that have complimentary magnetic fields that exert attractive forces to couple the first and second components 22, 24. As will be described in more detail hereinafter, one or both of the coupling components 39, 53 can include a plurality of magnets (or other magnetic field sources) that in combination generates an asymmetric magnetic field, which may generally be characterized by magnetic field lines having different magnitudes and/or directions at different positions throughout a plane that intersects the asymmetric magnetic field. In another example, one of the coupling components may include a magnetic field source that generates an asymmetric magnetic field, and the other coupling component may include a magnetic material that is attracted to the asymmetric magnetic field. In further alternate examples, one of the coupling components could be a ferrous material, such as an iron plate or iron bar.

In one embodiment, the sensor 38 is a magnetic field sensor that generates signals that are indicative of the asymmetric magnetic field generated by the coupling component 53. When the sensor 38 is moved through the asymmetric magnetic field, the sensor generates different signals that are indicative of the asymmetric magnetic field at different positions. The processor 30 can interpret these signals from the sensor 38 as user inputs to control one or more operational settings of the device, such as increasing and decreasing a volume of the device, turning the device on and off, switching between auditory stimulation settings (e.g., different user stimulation maps or programs that are defined generally by threshold and comfort hearing levels), switching between different listening modes (e.g., directional or omnidirectional microphone modes, telephone mode, music mode, direct audio input port mode, and wireless streaming) and the like. Further, different user stimulation maps or programs can have settings that are optimized for different listening modes, and the user interface described herein can be used to switch between such user simulation maps.

Alternatively or in conjunction, the sensor 52 can function similarly to generate signals that are indicative of the asymmetric magnetic field generated by the coupling component 53 as the sensor 52 is moved relative to the asymmetric magnetic field, and the processor 44 can interpret these signals as user inputs to control operational settings of the device. Generally, the sensors 38, 52 may include one or more sensors, such as hall-effect sensors, search-coil sensors, magnetotransistor sensors, magnetodiode sensors, magneto-optical sensors, giant magnetoresistive sensors, and the like, and may be configured to sense the magnetic field (magnitude and direction) in one or more axes.

The transducer 28 may include a microphone that is configured to receive external audible sounds 60. Further, the microphone may include combinations of one or more omnidirectional or directional microphones that are configured to receive background sounds and/or to focus on sounds from a specific direction, such as generally in front of the prosthesis recipient. Alternatively or in addition, the transducer 28 may include telecoils or other sound transducing components that receive sound and convert the received sound to electronic signals. Further, the device 20 may be configured to receive sound information from other sound input sources, such as electronic sound information received through the data interface 26 of the first component 22 or from the communication electronics 42 of the second component 24.

In one example, the processor 30 of the first component 22 is configured to convert or encode the audible sounds 60 (or other electronic sound information) into encoded electronic signals that include audio data that represents sound information, and to apply the encoded electronic signals to the communication electronics 32. In the present example, the communication electronics 32 of the first component 22 are configured to transmit the encoded electronic signals as electronic output signals 62 to the communication electronics 42 of the second component 24. Illustratively, the communication electronics 32, 42 can include magnetically coupled coils that establish an RF link between the units 22, 24. Accordingly, the communication electronics 32 can transmit the output signals 62 encoded in a varying or alternating magnetic field over the RF link between the components 22, 24.

Generally, the communication electronics 32, 42 can include an RF inductive transceiver system or circuit. Such a transceiver system may further include an RF modulator, a transmitting/receiving coil, and associated driver circuitry for driving the coil to radiate the output signals 62 as electromagnetic RF signals. Illustratively, the RF link can be an On-Off Keying (OOK) modulated 5 MHz RF link, although different forms of modulation and signal frequencies can be used in other examples.

Each of the power supplies 36, 50 provides power to various components of the first and second components 22, 24, respectively. In another variation of the system 20 of FIG. 1, one of the power supplies may be omitted, for example, the system may include only the power supply 36, which is used to provide power to both the first and second components 22, 24. The power supplies 36, 50 can be any suitable power supply, such as non-rechargeable or rechargeable batteries. In one example, one or more both of the power supplies 36, 50 are batteries that can be recharged wirelessly, such as through inductive charging. Generally, a wirelessly rechargeable battery facilitates complete subcutaneous implantation of a device to provide fully or at least partially implantable prostheses. A fully implanted hearing prosthesis has the added benefit of enabling the recipient to engage in activities that expose the recipient to water or high atmospheric moisture, such as swimming, showering, saunaing, etc., without the need to remove, disable or protect, such as with a water/moisture proof covering or shield, the hearing prosthesis. A fully implanted hearing prosthesis also spares the recipient of stigma, imagined or otherwise, associated with use of the prosthesis.

Further, the data storage 34, 48 may be any suitable volatile and/or non-volatile storage components. The data storage 34, 48 may store computer-readable program instructions and perhaps additional data. In some embodiments, the data storage 34, 48 stores data and instructions used to perform at least part of the processes disclosed herein and/or at least part of the functionality of the systems described herein. Although the data storage 34, 48 in FIG. 1 are illustrated as separate blocks, in some embodiments, the data storage can be incorporated, for example, into the processor(s) 30, 44, respectively.

As mentioned above, the processor 30 is configured to convert the audible sounds 60 into encoded electronic signals, and the communication electronics 32 are configured to transmit the encoded electronic signals as the output signals 62 to the communication electronics 42. In particular, the processor 30 may utilize configuration settings, auditory processing algorithms, and a communication protocol to convert the audible sounds 60 into the encoded electronic signals that are transmitted as the output signals 62. One or more of the configuration settings, auditory processing algorithms, and communication protocol information can be stored in the data storage 34. Illustratively, the auditory processing algorithms may utilize one or more of speech algorithms, filter components, or audio compression techniques. The output signals 62 can also be used to supply power to one or more components of the second component 24. Generally, the encoded electronic signals themselves include power that can be supplied to the second component 24. Additional power signals can also be added to the encoded electronic signals to supply power to the second component 24.

The second component 24 can then apply the encoded electronic signals to the stimulation electronics 46 to allow a recipient to perceive the electronic signals as sound. Generally, the stimulation electronics 46 can include a transducer or actuator that provides auditory stimulation to the recipient through one or more of electrical nerve stimulation, audible sound production, or mechanical vibration of the cochlea, for example.

In the present example, the communication protocol defines how the encoded electronic signals are transmitted from the first component 22 to the second component 24. For example, the communication protocol can be an RF protocol that the first component applies after generating the encoded electronic signals, to define how the encoded electronic signals will be represented in a structured signal frame format of the output signals 62. In addition to the encoded electronic signals, the communication protocol can define how power signals are supplied over the structured signal frame format to provide a more continuous power flow to the second component 24 to charge the power supply 50, for example. Illustratively, the structured signal format can include output signal data frames for the encoded electronic signals and additional output signal power frames.

Once the encoded electronic signals and/or power signals are converted into the structured signal frame format using the communication protocol, the encoded electronic signals and/or power signals can be provided to the communication electronics 32, which can include an RF modulator. The RF modulator can then modulate the encoded electronic signals and/or power signals with a carrier signal, e.g., a 5 MHz carrier signal, and the modulated signals can then be transmitted over the RF link from the communication electronics 32 to the communication electronics 40. In various examples, the modulations can include OOK or frequency-shift keying (FSK) modulations based on RF frequencies between about 100 kHz and 50 MHz.

The second component 24 may then receive the output signals 62 via the communication electronics 42. In one example, the communication electronics 42 include a receiving coil and associated circuitry for receiving electromagnetic RF signals, such as the output signals 62. The processor 44 is configured to then decode the output signals 62 and extract the encoded electronic signals. And the processor 44 can then apply the encoded electronic signals and the included audio data to the recipient via the stimulation electronics 46 to allow the recipient to perceive the electronic signals as sound. Generally, the stimulation electronics 46 can include a transducer or actuator that provides auditory stimulation to the recipient through one or more of electrical nerve stimulation, audible sound production, or mechanical vibration of the cochlea, for example. Further, when the output signals 62 include power signals, the communication electronics 42 are configured to apply the received output signals 62 to charge the power supply 50.

As described generally above, the communication electronics 32 can be configured to transmit data and power to the communication electronics 42. Likewise, the communication electronics 42 can be configured to transmit signals to the communication electronics 32, and the communication electronics 32 can be configured to receive signals from the second component 24 or other devices or components.

Referring back to the stimulation electronics 46 of FIG. 1, these electronics can take various forms depending on the type of hearing prosthesis. Illustratively, in embodiments where the hearing prosthesis 20 is a direct acoustic cochlear stimulation device, the microphone 28 is configured to receive the audible sounds 60, and the processor 30 is configured to encode the audible sounds (or other electronic sound information) into the output signals 62. In this example, the communication electronics 42 receive the output signals 62, and the processor 44 applies the output signals to the recipient's inner ear via the stimulation electronics 46. In that example, the stimulation electronics 46 includes or is otherwise connected to an auditory nerve stimulator to transmit sound to the recipient via direct mechanical stimulation.

For embodiments where the hearing prosthesis 20 is a bone conduction device, the microphone 28 and the processor 30 are configured to receive, analyze, and encode audible sounds 60 (or other electronic sound information) into the output signals 62. The communication electronics 42 receive the output signals 62, and the processor 44 applies the output signals to the bone conduction device recipient's skull via the stimulation electronics 46. In this embodiment, the stimulation electronics 46 may include an auditory vibrator to transmit sound to the recipient via direct bone vibrations, for example.

In addition, for embodiments where the hearing prosthesis 20 is an auditory brain stem implant, the microphone 28 and the processor 30 are configured to receive, analyze, and encode the audible sounds 60 (or other electronic sound information) into the output signals 62. The communication electronics 42 receive the output signals 62, and the processor 44 applies the output signals to the auditory brain stem implant recipient's auditory nerve via the stimulation electronics 46 that, in the present example, includes one or more electrodes.

In embodiments where the hearing prosthesis 20 is a cochlear implant, the microphone 28 and the processor 30 are configured to receive, analyze, and encode the external audible sounds 60 (or other electronic sound information) into the output signals 62. The communication electronics 42 receive the output signals 62, and the processor 44 applies the output signals to an implant recipient's cochlea via the stimulation electronics 46. In this example, the stimulation electronics 46 includes or is otherwise connected to an array of electrodes.

Further, in embodiments where the hearing prosthesis 20 is an acoustic hearing aid or a combination electric and acoustic bimodal hearing prosthesis, the microphone 28 and the processor 30 are configured to receive, analyze, and encode audible sounds 60 (or other electronic sound information) into output signals 62. The communication electronics 42 receive the output signals 62, and the processor 44 applies the output signals to a recipient's ear via the stimulation electronics 46 comprising a speaker, for example.

The device 20 illustrated in FIG. 1 further includes an external computing device 70 that is configured to be communicatively coupled to the first component 22 (and/or the second component 24) via a connection or link 72. The link 72 may be any suitable wired connection, such as an Ethernet cable, a Universal Serial Bus connection, a twisted pair wire, a coaxial cable, a fiber-optic link, or a similar physical connection, or any suitable wireless connection, such as Bluetooth®, Wi-Fi®, inductive or electromagnetic coupling or link, and the like.

In general, the computing device 70 and the link 72 are used to operate the device 20 in various modes. In a first example mode, the computing device 70 is used to develop and/or load a recipient's configuration data to the device 20, such as through the data interface 26. In another example mode, the computing device 70 is used to upload other program instructions and firmware upgrades, for example, to the device 20. In yet other example modes, the computing device 70 is used to deliver data (e.g., sound information or the predetermined orientation data) and/or power to the device 20 to operate the components thereof and/or to charge the power supplies 36, 50. Still further, the computing device 70 and the link 72 can be used to implement various other modes of operation of the prosthesis 20.

The computing device 70 can further include various additional components, such as a processor and a power source. Further, the computing device 70 can include a user interface or input/output devices, such as buttons, dials, a touch screen with a graphical user interface, and the like, that can be used to turn the one or more components of the device 20 on and off, adjust the volume, switch between one or more operating modes and user stimulation maps, adjust or fine tune the configuration data, etc. Various modifications can be made to the device 20 illustrated in FIG. 1. For example, a user interface or input/output devices can be incorporated into the first component 22 and/or the second component 24. In another example, the second component 24 can include one or more microphones. In a further example, the first component 22 may include the stimulation electronics 46 of the second component 24, and the second component may be coupling components for coupling the first component 22 to the recipient and for coupling auditory stimulation to the recipient. Generally, the device 20 may include additional or fewer components arranged in any suitable manner. In some examples, the device 20 may include other components to process external audio signals, such as components that measure vibrations in the skull caused by audio signals and/or components that measure electrical outputs of portions of a person's hearing system in response to audio signals.

Figure 2:
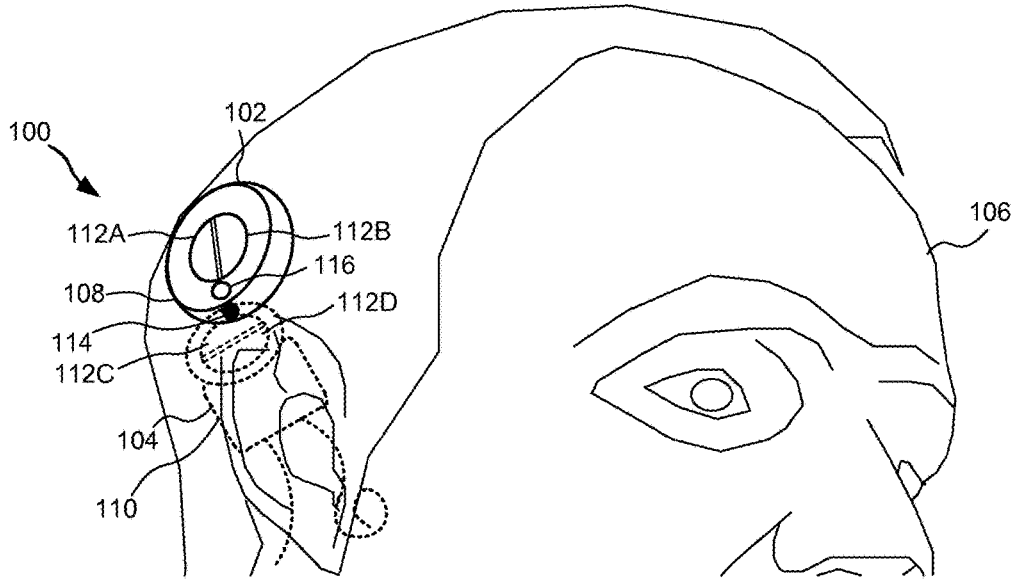
FIG. 2 illustrates a partially cut-away, isometric view of a hearing prosthesis coupled to a recipient in accordance with an embodiment of the present disclosure.

In the embodiment illustrated in FIG. 2, an example hearing prosthesis 100 is shown coupled to a recipient's hearing system. In FIG. 2, an external component 102 corresponds to the first component 22, and an implantable component 104 that is implanted in a person 106 corresponds to the second component 24. As illustrated, the external component 102 includes a generally symmetrical housing 108 (e.g., a circular housing) that partially or fully encloses various other components, such as the components shown in FIG. 1. The implantable component 104 may also include a housing 110 that hermetically seals various components, such as the component shown in FIG. 1.

Figure 3:
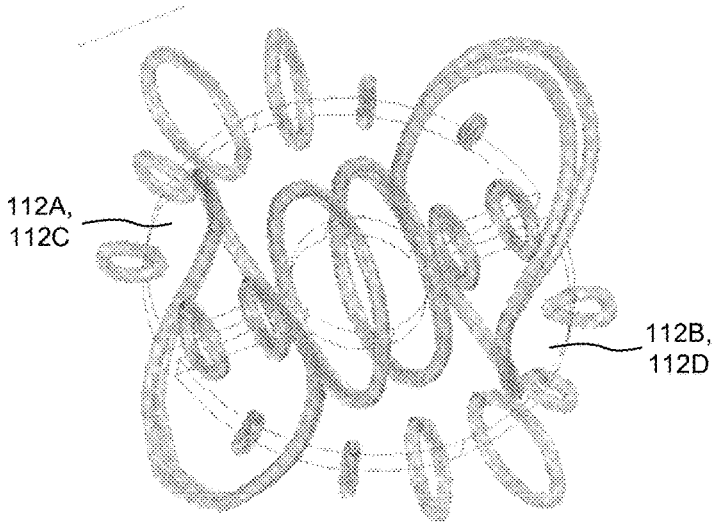
FIG. 3 is an isometric, diagrammatic view of a rotationally asymmetric magnetic field in accordance with an embodiment of the present disclosure.

In one embodiment, the external component 102 and the implantable component 104 may include components for coupling the external component with the implantable component. In one example, the coupling mechanism may use one or more magnets or other magnetic field sources 112 that are included in one or more of the external component 102 or the implantable component 104. Illustratively, the external component 102 may include magnets 112A, 112B, and the implantable component may include magnets 112C, 112D. In this example, the magnet 112A represents a north pole and the magnet 112B represents a south pole. Similarly, the magnet 112C represents a north pole and the magnet 112D represents a south pole. This arrangement of magnets provides one example of an asymmetric magnetic field, as illustrated in FIG. 3, which shows a representation of magnetic flux lines from a north and south pole magnet arrangement. In FIG. 3, a direction of the magnetic flux lines is directed generally away from the magnets 112A, 112C and into the magnets 112B, 112D.

Figure 5:
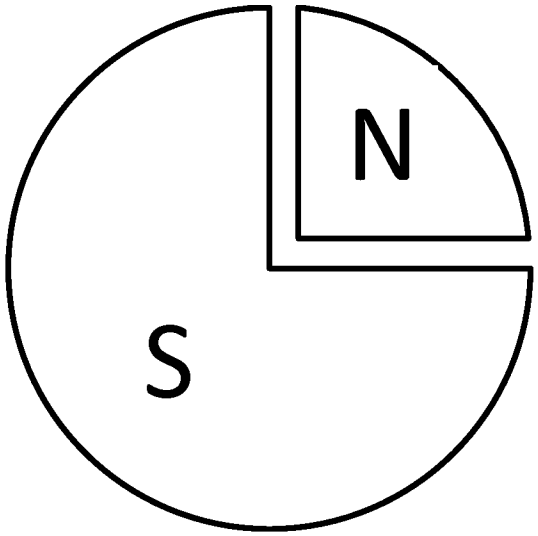
FIG. 5 is a diagrammatic illustration of a magnetic pole arrangement according to another embodiment of the present disclosure.
Figure 4:
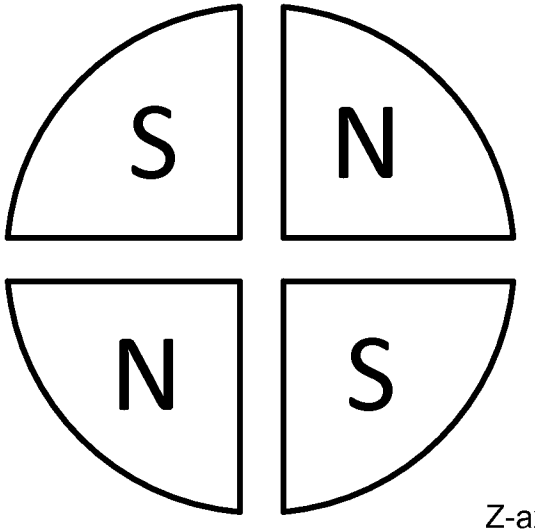
FIG. 4 is a diagrammatic illustration of a magnetic pole arrangement according to an embodiment of the present disclosure.
Figure 4:
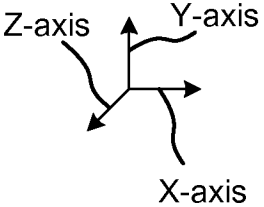

In the example of FIG. 2, there are attractive magnetic forces between the magnets 112A, 112B and the magnets 112D, 112C, respectively. It should be understood that each magnetic pole 112A-112D includes an opposite magnetic pole on an opposing face of each magnet. Other coupling mechanisms and arrangements of magnets are also possible. For instance, the magnets 112A, 112B may be replaced by a magnetic material (e.g., a soft magnetic material) that is attracted to the magnets 112C, 112D. Alternatively, the magnets 112C, 112D may be replaced by a magnetic material (e.g., a soft magnetic material) that is attracted to the magnets 112A, 112B. FIGS. 4 and 5 illustrate other magnetic pole arrangements that provide rotationally asymmetric magnetic fields about a Z-axis, as shown in the figures. Generally, the Z-axis is orthogonal to a plane defined by X- and Y-axes, and the X- and Y-axes are disposed generally in a plane of the figure page.

In FIG. 2, the external component 102 also includes one or more magnetic field sensors 114 and a pushbutton or other manual input component 116. As the external component 102 is moved with respect to the implantable component 104 (e.g., rotated with respect to the implantable component or moved up/down/left/right with respect to the implantable component), the magnetic field sensor 114 generates different electrical signals that are indicative of the asymmetric magnetic field. A processor (such as the processor 30) coupled to the external component may interpret the electrical signals from the sensor 114 as user inputs to control operational settings of the hearing prosthesis.

In one embodiment, the processor may interpret the electrical signals from the sensor 114 only after the user presses the pushbutton 116. In one example, a volume change action can be initiated by a pressing the pushbutton 116 while simultaneously rotating the external component with respect to the implantable component, and then releasing the button. The sensor 114 generates a signal that is indicative of the rotated angle of the external component. The processor can then change the volume of the hearing prosthesis in accordance with the rotated angle. Illustratively, a clockwise rotation of the external component can increase the volume of the hearing prosthesis, while a counter-clockwise rotation can decrease the volume. In another example, the processor is configured to interpret the electrical signals from the sensor 114 for a predetermined time period after the pushbutton 116 is pressed. Generally, the use of the pushbutton 116 to trigger the processor to interpret the signals from the sensor 114 can be helpful to distinguish from inadvertent movements of the sensor 114.

In other examples, a rotation of the sensor 114 (with or without pressing a pushbutton) can be used to turn on and off the device or to switch between auditory stimulation settings or listening modes of the device. The movement of the sensor 114 can also be used to control other operational settings of the device. Further, in other embodiments, the processor can utilize a signal analysis algorithm to monitor the signal from the magnetic sensor and to identify user-input movements, as distinguished from other non-user-input movements. In these embodiments, the pushbutton 116 may be omitted.

In yet another example, a rotation of the external component with respect to the implantable component can be used as a volume control and to switch between user stimulation programs. In this example, the rotation of the external component together with pressing a pushbutton can control one of the volume or the user simulation program, and the rotation of the external component without pressing the pushbutton can control the other of the volume or the user stimulation program. Other examples of movements of the external component with respect to the internal component, with or without pressing the pushbutton, can be used to individually control different operational settings.

Figure 6A:
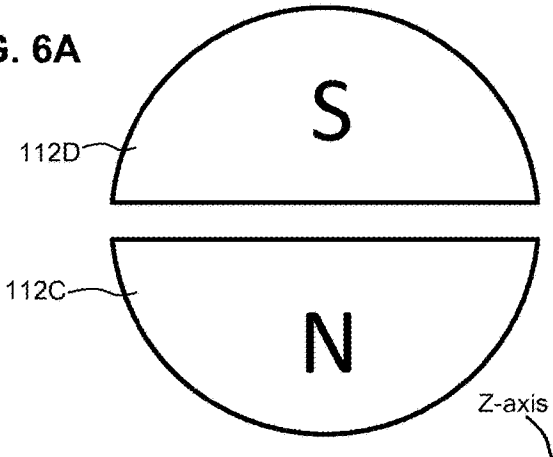
FIGS. 6A-6E are diagrammatic illustrations of a sensor configuration that is moved with respect to a magnetic pole arrangement, in accordance with an embodiment of the present disclosure.
Figure 6B:
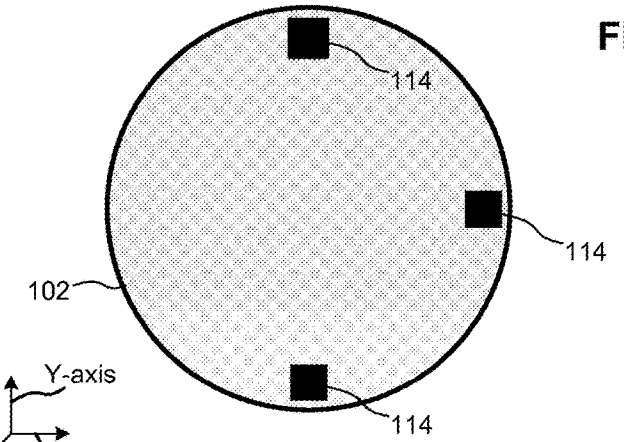
Figure 6C:
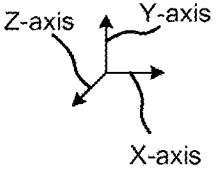
Figure 6C:
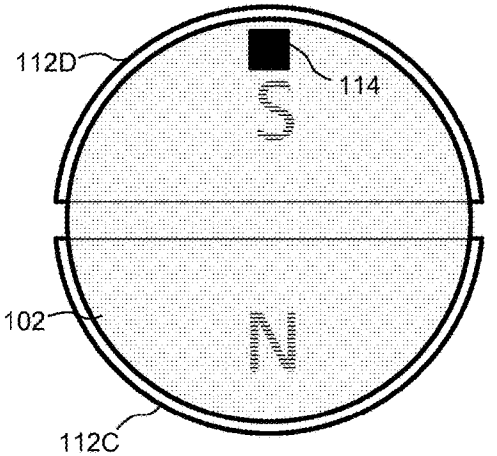
Figure 6D:
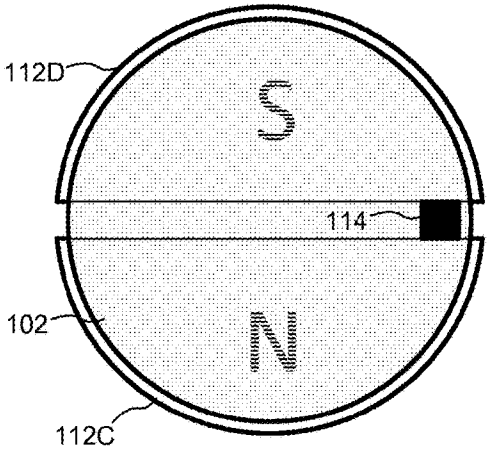
Figure 6E:
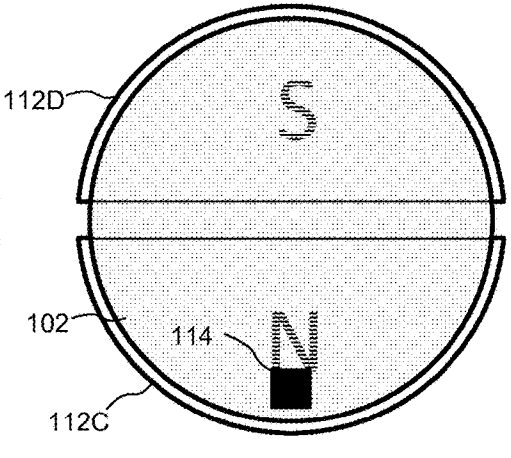

FIG. 6A-6E illustrate examples of the external component 102 and the sensor 114 being rotated with respect to the asymmetric magnetic field generated by the magnets 112C, 112D. FIG. 6B also illustrates examples of multiple magnetic field sensors 114 that are coupled to the external component 102. In one example, multiple magnetic field sensors 114 may help to identify different movements of the external component 102 that correspond to different user inputs, such as clockwise and counterclockwise rotations.

Generally, as seen in FIGS. 2 and 6A-6E, the sensor 114 can be offset or spaced from a central axis of the magnetic field. Illustratively, this central axis may extend along the Z-direction (coming out of the paper) and be positioned at a central location of a magnet configuration. The sensor 114 can then be moved in a plane that is orthogonal to the central axis (e.g., the XY-plane), such that the sensor 114 is moved through positions of the magnetic field that are characterized by different magnitudes and/or directions.

As mentioned above, the sensor 114 may include one or more sensors, such as hall-effect sensors, search-coil sensors, magneto-transistor sensors, magnetodiode sensors, magneto-optical sensors, giant magnetoresistive sensors, and the like, and may also be configured to sense the magnetic field in one or more axis. In one example, one or more sensors are used that may each be configured to sense the magnetic field along a single axis, and these single-axis sensor(s) may be aligned so that the sensing axis is parallel with the XY-plane or orthogonal to the Z-axis (referring to FIGS. 6A-6E, for example). Such an arrangement of single-axis sensor(s) may provide magnetic field measurements that are more dependent on an orientation of the sensor in the magnetic field (as compared to an arrangement with the sensor axis aligned parallel to the Z-axis, for example). Thus, these magnetic field measurements can be used perhaps more efficiently to track movements of the sensor in the magnetic field (again, as compared to an arrangement with the sensor axis aligned parallel to the Z-axis, for example).

Figure 7:
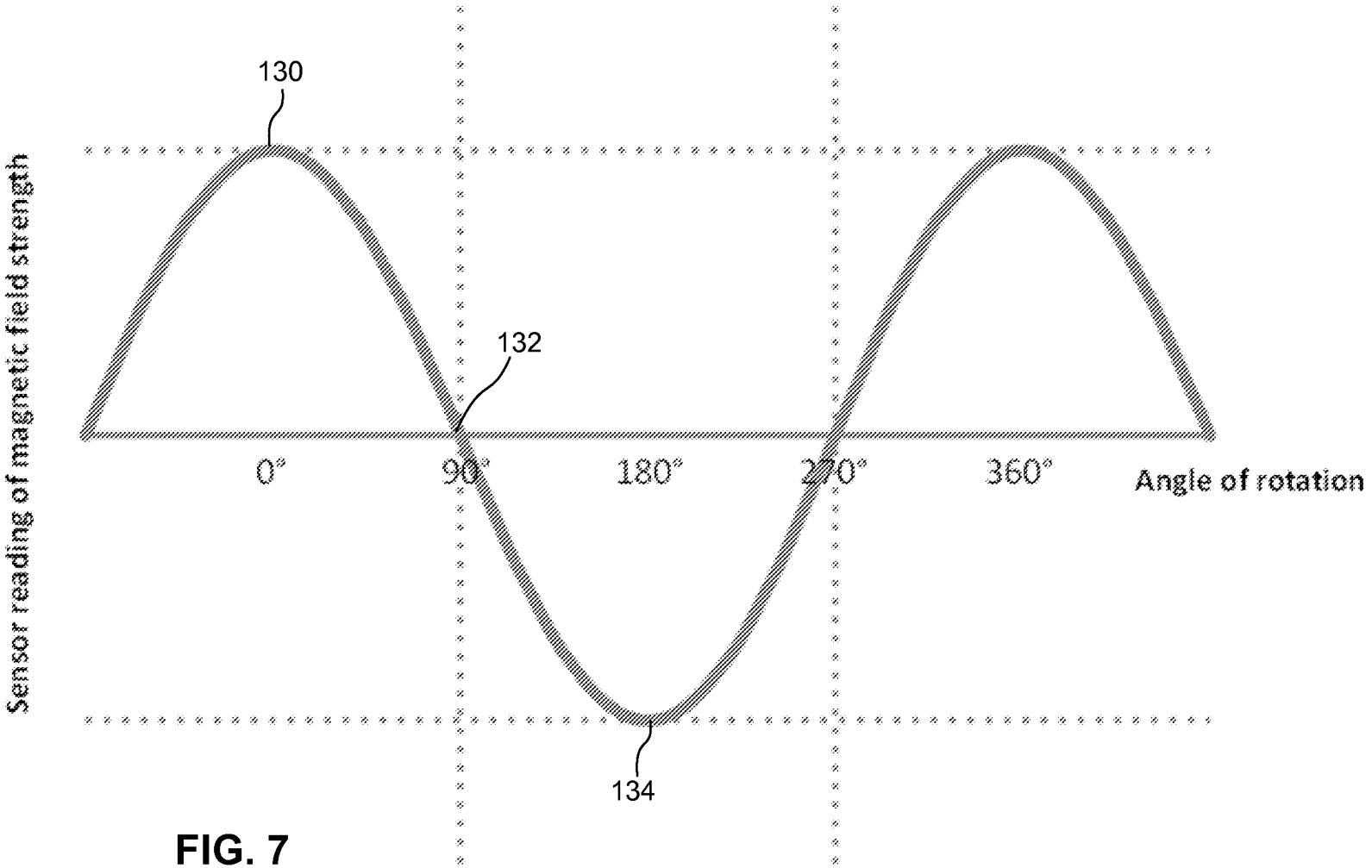
FIG. 7 illustrates example output signals from a sensor of the embodiment illustrated in FIGS. 6A-6E.

Referring to FIG. 7, example output signals from the sensor 114 are illustrated as the sensor 114 is rotated with respect to the magnets 112C, 112D. More particularly, the sensor position in FIG. 6C may correspond to a high value at point 130 of FIG. 7, the sensor position in FIG. 6D may correspond to a zero value at point 132 of FIG. 7, and the sensor position in FIG. 6E may correspond to a negative or low value at point 134 of FIG. 7. The processor may also process changing output signals from the sensor 114 over time to determine a direction of movement of the sensor with respect to the asymmetric magnetic field. The processor may also be configured to interpret different movement directions of the sensor as different user inputs. For example, a clockwise movement of the sensor may be used to control an operational setting in a different way than a counterclockwise movement. In other examples, up/down, left/right, and/or movements of the sensor closer to/farther away from the magnetic field can be detected and associated with different operational setting adjustments. In another example, the processor may also process a rate of change in the output signals from the sensor 114 over time, and use the rate of change information to control operational settings.

Figure 8A:
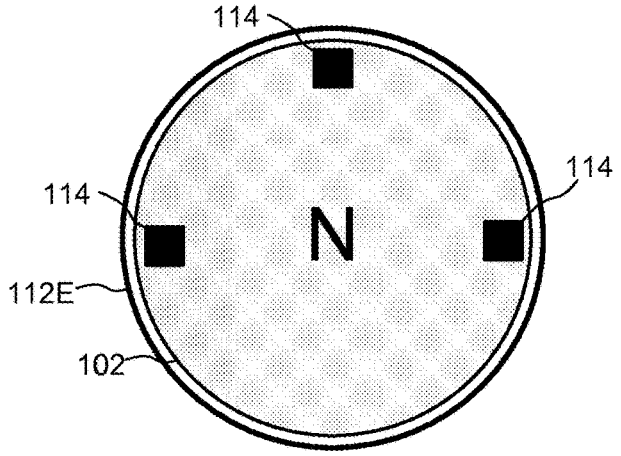
FIGS. 8A-8C are diagrammatic illustrations of a sensor configuration that is moved with respect to a magnetic pole arrangement, in accordance with an embodiment of the present disclosure.
Figure 8B:
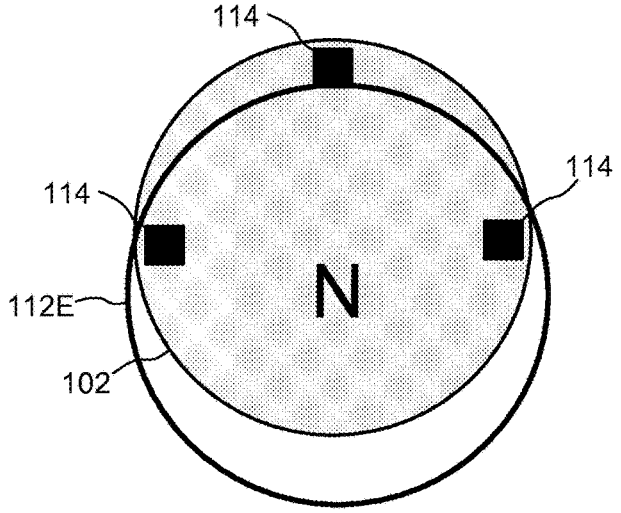
Figure 8C:
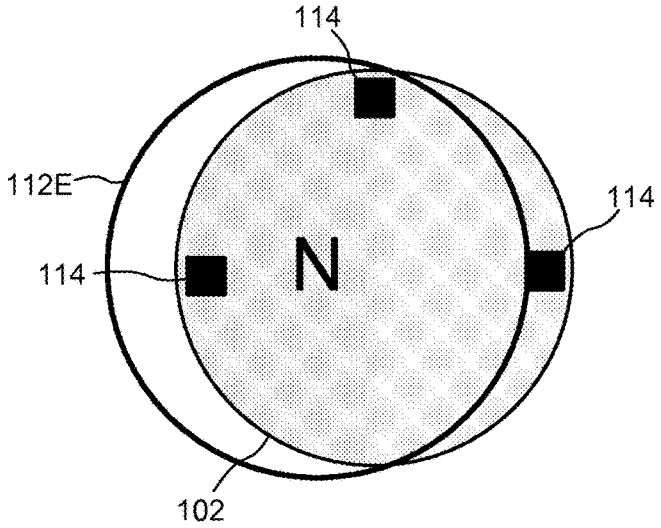

FIGS. 8A-8B illustrate another example similar to FIGS. 6A-6E, except the magnets 112C, 112D are replaced by a single magnet 112E, which is illustrated as representing a north pole that generates a symmetrical magnetic field. In this example, the magnetic field sensors 114 may be configured so that movements of the external component with respect to the magnet 112E can be detected and distinguished from one another. FIGS. 8A-8C show one example arrangement of magnetic field sensors 114 that are configured to detect movements of the external component with respect to the magnet, such as movements up/down, left/right, and/or movements of the sensor closer to/farther away from the magnetic field.

Figure 9A:
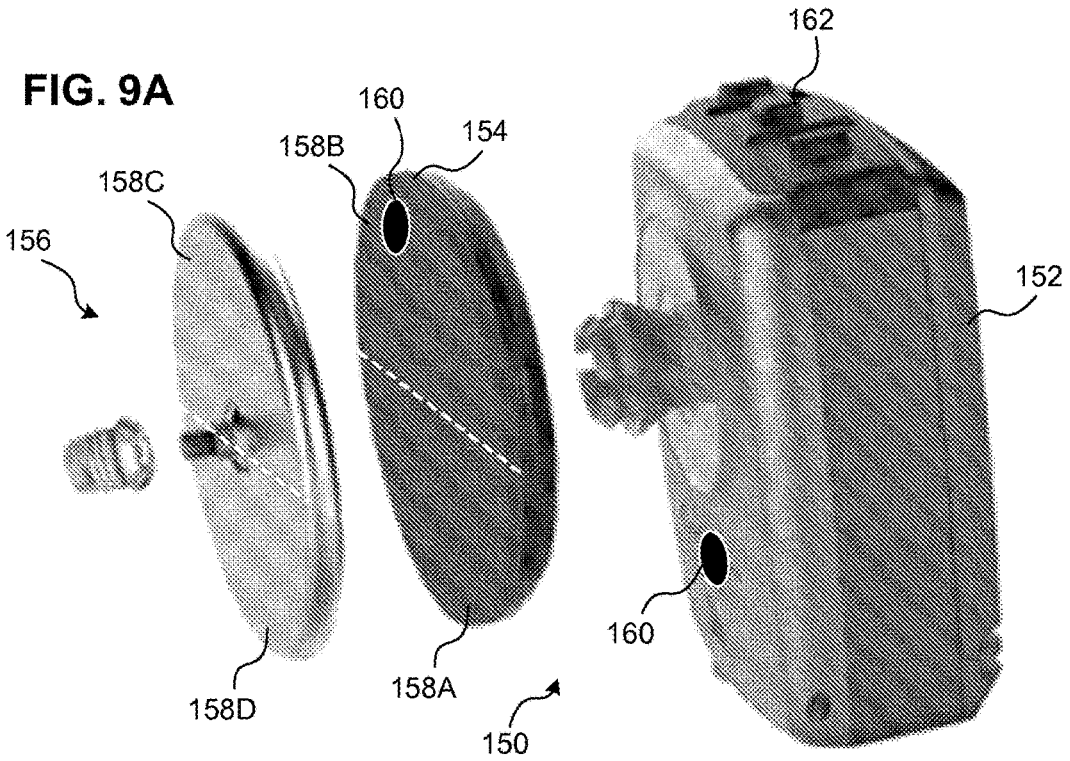
FIG. 9A illustrates an exploded, isometric view of a hearing prosthesis m accordance with an embodiment of the present disclosure.
Figure 9B:
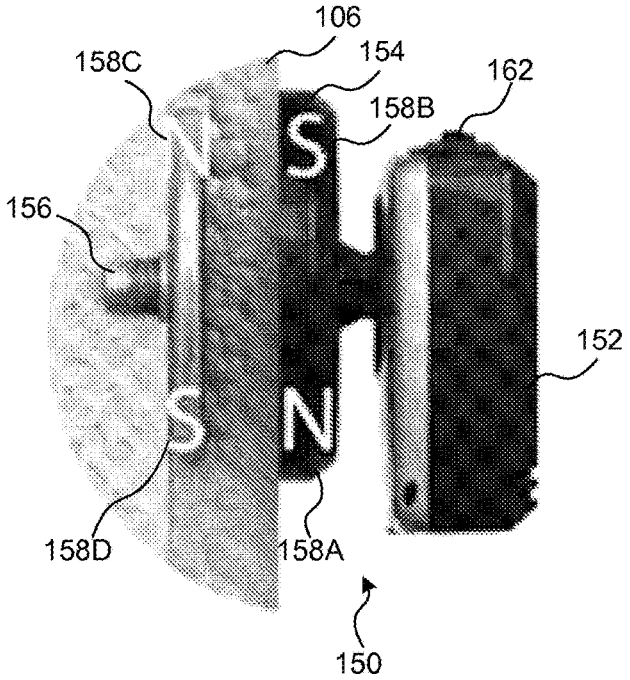
FIG. 9B is a generally side elevational view of the hearing prosthesis of FIG. 8A coupled to a recipient.

Referring now to FIGS. 9A and 9B, another example hearing prosthesis 150 is illustrated. The hearing prosthesis 150 is a bone conduction hearing prosthesis that includes an external component 152 that is coupled to a first coupling component 154. The hearing prosthesis 150 also includes a second coupling component 156 that is configured to be implanted in a recipient 106. In this example, the first coupling component 154 includes a north-pole portion 158A and a south-pole portion 158B, and the second coupling component 156 includes a north-pole portion 158C and a south-pole portion 158D. As discussed above, such an arrangement of magnetic poles provides a rotationally asymmetric magnetic field. Complimentary poles of the first and second coupling components allow the external component to be transcutaneously coupled to the recipient.

The external component 152 may combine various components illustrated in FIG. 1. For example, the external component may include the components of the first component 22 and also may include the stimulation electronics 46 of the second component 24. Generally, in use, the external component receives, analyze, and encode audible sounds into outputs signals that are applied to the stimulation electronics. In this example, the stimulation electronics may include an auditory vibrator to transmit sound to the recipient via direct bone vibrations that are coupled to the recipient via the second coupling component 156.

Further, the external component 152 in this embodiment includes one or more magnetic field sensors 160 and a pushbutton 162. FIG. 9A also illustrates an embodiment that includes a magnetic field sensor coupled to the coupling component 154. Generally, positioning a magnetic field sensor 160 in (or adjacent to) the plane of the magnetic field between the coupling components 154, 156 may provide more accurate magnetic field measurements, as compared to positioning the magnetic field sensor spaced from the magnetic field between the coupling components. Although, positioning the magnetic field sensor 160 on the external component 152 may be an effective arrangement in embodiments where the external component 152 is moved or rotated with respect to both coupling components 154, 156, for example.

As the external component 154 is moved with respect to the asymmetric magnetic field of the second coupling component 156 (e.g., rotated with respect to the second coupling component or moved up/down/left/right with respect to the coupling component), the magnetic field sensor 160 generates different electrical signals that are indicative of the asymmetric magnetic field. A processor (such as the processor 30) coupled to the external component may interpret the electrical signals from the sensor 160 as user inputs to control operational settings of the hearing prosthesis. As similarly discussed above, in one embodiment, the processor may interpret the electrical signals from the sensor 160 only after the recipient presses the pushbutton 162 (e.g., while the pushbutton is depressed and/or for a predetermined time period after the pushbutton is pressed).

Figure 10:
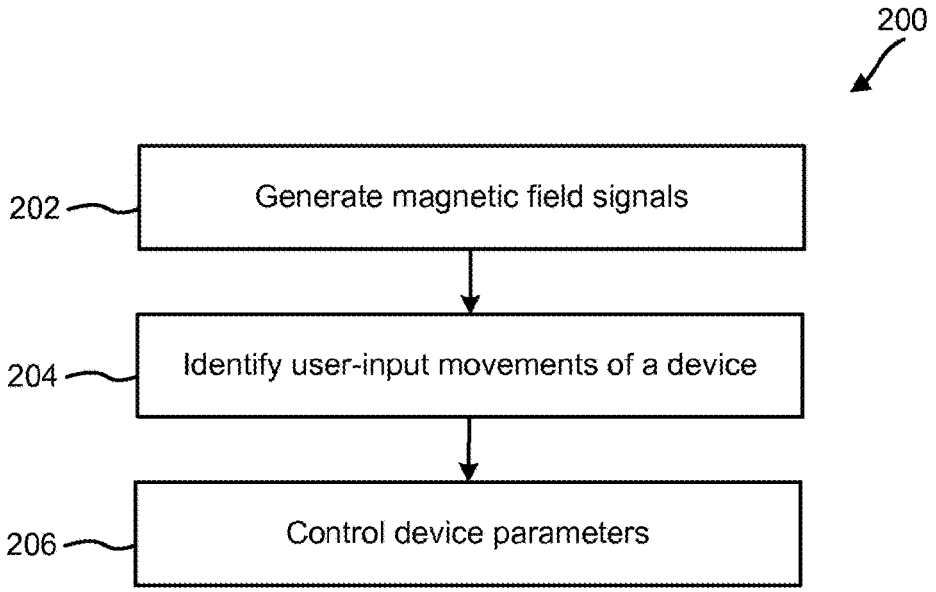
FIG. 10 is a flowchart showing a method for receiving user input and controlling a device in accordance with an embodiment of the present disclosure.

Referring now to FIG. 10 and with further reference to the description above, one example method 200 is illustrated for adjusting one or more operational settings of a device, such as the device 20 of FIG. 1. Generally, the method 200 may include one or more operations, functions, or actions as illustrated by one or more of blocks 202-206. Although the blocks 202-206 are illustrated in sequential order, these blocks may also generally be performed concurrently and/or in a different order than illustrated. The method 200 may also include additional or fewer blocks, as needed or desired. For example, the various blocks 202-206 can be combined into fewer blocks, divided into additional blocks, and/or removed based upon a desired implementation.

The method 200 can be performed using the devices 20, 100, and 150 described above, for example, or some other device that is configured to detect movements of the device with respect to a magnetic field. In the method 200, at block 202, a magnetic field sensor generates signals that are indicative of a magnetic field. At block 204, a processor identifies user-input movements of the device based on the magnetic field signals and, at block 206, the processor controls device settings in response to the identified user-input movements.

More particularly, in the method 200, a recipient of a hearing prosthesis device, such as any of the devices described herein, may move a component of the hearing prosthesis in relation to a magnetic field that is generated by the hearing prosthesis. As discussed above, the component may include the magnetic field sensor and the magnetic field may be a rotationally asymmetric magnetic field. As the recipient moves the magnetic field sensor through the rotationally asymmetric magnetic field, the sensor generates changing electrical signals that are indicative of the changing magnitudes and directions at different locations of the magnetic field.

Generally at block 204, the processor can process these changing electrical signals to identify specific user-input movements of the device. In one embodiment, the processor processes the changing electrical signals after a user presses a pushbutton, as described above. In another embodiment, the processor can utilize a signal analysis algorithm to monitor the signal from the magnetic sensor and to identify user-input movements, as distinguished from other non-user-input movements.

For example, the signal analysis algorithm may determine an initial or preset position of the magnetic field sensor with respect to the magnetic field, and then may monitor the signal from the magnetic sensor to detect movements away from the initial position. The signal analysis algorithm may also utilize a movement threshold and/or a time delay to help to identify user-input movements. For example, the signal analysis algorithm may only identify a user-input movement that is greater than a given threshold (e.g., greater than about 5 mm). The signal analysis algorithm may also require a user-input movement to be characterized by moving the sensor away from an initial position and then holding the sensor stationary for greater than a given time delay. Such a time delay may be useful in some of the embodiment disclosed herein where the magnetic forces between the coupling components tends to re-align the device toward the initial position. In some embodiments, the magnetic forces re-align the components into an optimal configuration after the recipient releases the external component.

At block 204, the processor may also be configured to determine characteristics of the user-input movement, such as a direction and/or magnitude of the movement. At block 206, the processor can use these movement characteristics to control operational settings of the device such as increasing or decreasing a volume, turning the device on or off, adjust hearing thresholds, switching between operating modes, and the like. In one example, the processor uses the direction of movement to determine whether to increase or decrease the volume, and uses the magnitude of the movement to determine an amount of volume increase or decrease.

Each block 202-206 may represent a module, a segment, or a portion of program code, which includes one or more instructions executable by a processor for implementing specific logical functions or steps in the process. The program code may be stored on any type of computer-readable medium or storage device including a disk or hard drive, for example. The computer-readable medium may include non-transitory computer-readable medium, such as computer-readable media that stores data for short periods of time like register memory, processor cache, and Random Access Memory (RAM). The computer-readable medium may also include non-transitory media, such as secondary or persistent long-term storage, like read-only memory (ROM), optical or magnetic disks, compact-disc read-only memory (CD-ROM), etc. The computer-readable media may also include any other volatile or non-volatile storage systems. The computer-readable medium may be considered a computer-readable storage medium, for example, or a tangible storage device. In addition, one or more of the blocks 202-206 may represent circuitry that is wired to perform the specific logical functions of the method 200.

While various aspects and embodiments have been disclosed herein, other aspects and embodiments will be apparent to those skilled in the art. The various aspects and embodiments disclosed herein are for purposes of illustration and are not intended to be limiting, with the true scope being indicated by the following claims.

What is claimed is:

1. A hearing prosthesis, comprising:

a first component;

a second component, comprising:

at least one transducer configured to receive sound signals and to generate electrical signals therefrom, at least one processor configured to convert the electrical signals into encoded electronic signals, communication electronics configured to transmit the encoded electronic signals to the first component, a sensor configured to generate a signal in response to movement of the second component, wherein the at least one processor is configured to process the signal from the sensor to identify a direction and a magnitude of the movement of the second component and to use the direction and a magnitude of the movement of the second component to control one or more operational settings of the hearing prosthesis.

2. The hearing prosthesis of claim 1, wherein the first component comprises a first magnetic field source that generates a first magnetic field, and wherein the second component comprises a second magnetic field source that generates a second magnetic field that is complimentary to the first magnetic field, wherein the first component and the second component are configured to be coupled together by attractive forces exerted between the first and second magnetic fields.

3. The hearing prosthesis of claim 1, wherein the external component further comprises a manual input component configured to receive a manual input, wherein the at least one processor is communicatively coupled to the manual input component, and wherein the at least one processor is configured to process the manual input received by the manual input component, and to use the manual input and the signal from the sensor to control the one or more operational settings of the hearing prosthesis.

4. The hearing prosthesis of claim 1, wherein the at least one processor is configured to process the signal from the sensor using a signal analysis algorithm to distinguish between user-input movements and non-user-input movements, wherein the at least one processor is configured to control one or more operational settings of the hearing prosthesis in response to the user-input movements but not the non-user-input movements.

5. The hearing prosthesis of claim 1, wherein the at least one processor is configured to determine, based on signal from the sensor, that the movement of the second component is a rotation in a first direction and responsively increase a parameter of the hearing prosthesis.

6. The hearing prosthesis of claim 1, wherein the at least one processor is configured to determine, based on signal from the sensor, that the movement of the second component is a rotation in a second direction and responsively decrease a parameter of the hearing prosthesis.

7. The hearing prosthesis of claim 1, wherein the first component includes an actuator that is configured to use the electrical signal to provide auditory stimulation to a recipient of the hearing prosthesis.

8. A hearing prosthesis, comprising:

an implantable component configured to be implanted in a recipient and comprising stimulation electronics; and an external component comprising:

a sound input component that is configured to generate an electrical signal representative of one or more sounds, communication electronics configured to transmit encoded signals to the implantable component, wherein the encoded signals are generated based on the electrical signal representative of the one or more sounds and are configured for use by the stimulation electronics, a sensor configured to generate signals indicative of the orientation of the external component relative to the implantable component, at least one processor configured to process the signals from the sensor and to control one or more operational settings of the hearing prosthesis based on the orientation of the external component relative to the implantable component.

9. The hearing prosthesis of claim 8, wherein the external component further comprises a coupling component for coupling the external component to the implantable component via an attractive force exerted between the external component and the implantable component.

10. The hearing prosthesis of claim 8, wherein the at least one processor is configured to determine, based on the signals generated by the sensor, that the external component has a first orientation relative to the implantable component and responsively implement a first set of settings of the hearing prosthesis.

11. The hearing prosthesis of claim 10, wherein the at least one processor is configured to determine, based on the signals generated by the sensor, that the external component has a second orientation relative to the implantable component and responsively implement a second set of setting of the hearing prosthesis, wherein the second set of settings are different from the first set of settings.

12. The hearing prosthesis of claim 8, wherein the external component further comprises a manual input component configured to receive a manual input, wherein the at least one processor is communicatively coupled to the manual input component, and wherein the at least one processor is configured to process the manual input received by the manual input component, and to use the manual input and the signals generated by the sensor to adjust the one or more operational settings of the hearing prosthesis.

13. The hearing prosthesis of claim 8, wherein the at least one processor is configured to perform one or more sound processing operations on the electrical signals and to generate the encoded electronic signals for transmission by the communication electronics.

14. The hearing prosthesis of claim 8, wherein the sensor is configured to detect a rotated angle of the external component relative to a first coupled configuration, and wherein the signals generated by the sensor are representative of detected rotated angle of the external component.

15. A method, comprising:

detecting, via a sensor of an external component of a hearing prosthesis, movement of the external component, wherein the external component includes a sound input component that is configured to generate an electrical signal representative of one or more sounds, generating, using the sensor, a signal indicative of the movement of the external component;

determining, based on the signal generated by the sensor, a direction and a magnitude of the movement of the external component; and adjusting, based on both the magnitude and the direction of the movement of the external component, one or more operational settings of the hearing prosthesis.

16. The method of claim 15, further comprising:

determining, based on the signal generated by the sensor, that the movement of the external component is a rotation in a first direction and responsively increasing at least one operational setting of the hearing prosthesis; or determining, based on the signal generated by the sensor, that the movement of the external component is a rotation in a second direction and responsively decreasing the at least one operational setting of the hearing prosthesis.

17. The method of claim 16, further comprising:

using the magnitude of the rotation to determine an amount of increase or decrease in the at least one operational setting of the hearing prosthesis.

18. A method, comprising:

detecting, via a sensor of an external component of a hearing prosthesis, an orientation of the external component relative to an implantable component, wherein the external component includes a sound input component that is configured to generate electrical signals representative of one or more sounds, generating, using the sensor, signals representing the orientation of the external component relative to the implantable component; and a processor of the hearing prosthesis, adjusting one or more operational settings of the hearing prosthesis based on the signals representing the orientation of the external component relative to the implantable component.

19. The method of claim 18, further comprising:

at the processor, determining, based on the signals generated by the sensor, that the external component has a first orientation relative to the implantable component; and implement a first set of settings of the hearing prosthesis.

20. The method of claim 18, further comprising:

at the processor, determining, based on the signals generated by the sensor, that the external component has a second orientation relative to the implantable component; and implement a second set of setting of the hearing prosthesis, wherein the second set of settings are different from the first set of settings.

21. The method of claim 18, wherein the external component further comprises a manual input component configured to receive a manual input, wherein the at least one processor is communicatively coupled to the manual input component, and wherein the method further comprises:

at the processor, processing the manual input received by the manual input component; and using the manual input and the signals generated by the sensor to adjust the one or more operational settings of the hearing prosthesis.

22. The method of claim 18, further comprising:

performing at the processor, one or more sound processing operations on the electrical signals representative of one or more sounds to generate the encoded electronic signals; and sending the encoded electronic signals to the implantable component.

* * * * *